US008795026B2

(12) United States Patent
Geppert

(10) Patent No.: US 8,795,026 B2
(45) Date of Patent: Aug. 5, 2014

(54) STICK PUPPET

(75) Inventor: Brent Alan Geppert, Cerritos, CA (US)

(73) Assignee: Learning Resources, Inc., Vernon Hills, IL (US)

( * ) Notice: Subject to any disclaimer, the term of this patent is extended or adjusted under 35 U.S.C. 154(b) by 206 days.

(21) Appl. No.: 13/483,993

(22) Filed: May 30, 2012

(65) Prior Publication Data

US 2013/0324007 A1 Dec. 5, 2013

(51) Int. Cl.
*A63H 3/14* (2006.01)

(52) U.S. Cl.
USPC ..... 446/329

(58) Field of Classification Search
USPC ..... 446/71, 72, 82–84, 327, 329, 330, 338, 446/359
See application file for complete search history.

(56) References Cited

U.S. PATENT DOCUMENTS

| | | | | | |
|---|---|---|---|---|---|
| 2,114,851 | A * | 4/1938 | McCown | ..... | 446/329 |
| 2,633,670 | A * | 4/1953 | Steuber | ..... | 446/329 |
| 3,698,127 | A * | 10/1972 | Harp | ..... | 446/338 |
| 3,796,284 | A * | 3/1974 | Zeigner et al. | ..... | 185/39 |
| 4,695,265 | A * | 9/1987 | Clark | ..... | 446/329 |
| 5,145,445 | A * | 9/1992 | Northey | ..... | 446/329 |
| 5,167,562 | A * | 12/1992 | Axtell | ..... | 446/329 |
| 6,575,808 | B1 * | 6/2003 | Wright et al. | ..... | 446/321 |
| 6,589,094 | B2 * | 7/2003 | Spencer | ..... | 446/242 |
| 6,688,794 | B1 * | 2/2004 | Hsu | ..... | 401/195 |
| 7,025,655 | B2 * | 4/2006 | Chase | ..... | 446/392 |
| 2006/0183402 | A1 * | 8/2006 | von Jabba | ..... | 446/359 |

OTHER PUBLICATIONS

Realistic Dinosaur Grabbers, Oriental Trading, retrieved from Internet <URL: http://www.orientaltrading.com/realistic-dinosaur-grabbers-a2-5_682,fltr>.

* cited by examiner

*Primary Examiner* — Kurt Fernstrom
(74) *Attorney, Agent, or Firm* — Michael Best & Friedrich LLP

(57) ABSTRACT

A puppet includes a hollow outer shaft having a first end and a second end, an inner shaft disposed substantially within the outer shaft and slidable in a longitudinal direction relative to the outer shaft. The inner shaft includes a first end and an opposing second end. The puppet further includes a first puppet piece attached to the outer shaft near the first end thereof, a second puppet piece attached to the inner shaft near the first end thereof, and a lever connected to the inner shaft and extending outward therefrom through a first slot formed in the outer shaft. The second end of the inner shaft extends outside of the outer shaft. One of the first and second puppet pieces is movable relative to the other by sliding the lever longitudinally relative to the outer shaft or by moving the second end of the inner shaft away from the outer shaft.

17 Claims, 7 Drawing Sheets

STICK PUPPET

BACKGROUND

This invention relates generally to puppets, and more particularly, to a stick puppet.

Puppets have long been used as a toy and a form of entertainment by adults and children alike. Stick puppets are also known type of puppet made with one or more sticks or dowels. One type of stick puppet includes a puppet head on an upper end of the stick and a trigger at an opposite, lower end of the stick. The puppet is actuated by compressing the trigger so that one portion of the head opens relative to another portion of the head. The two portions of the head often form the mouth of the puppet so that repeated compression and release of the trigger simulates a speaking action of the puppet.

SUMMARY

A puppet according to an embodiment of the invention includes a hollow outer shaft having a first end and a second end, an inner shaft disposed substantially within the outer shaft and slidable in a longitudinal direction relative to the outer shaft, the inner shaft having a first end and an opposing second end. The puppet further includes a first puppet piece attached to the outer shaft near the first end thereof and a second puppet piece attached to the inner shaft near the first end thereof. The first and second puppet pieces may combine to form the head of the puppet. A lever connected to the inner shaft and extending outward therefrom through a first slot formed in the outer shaft. One of the first and second puppet pieces is movable relative to the other by sliding the lever longitudinally relative to the outer shaft or by moving the second end of the inner shaft away from the outer shaft.

DETAILED DESCRIPTION

Figure 1:
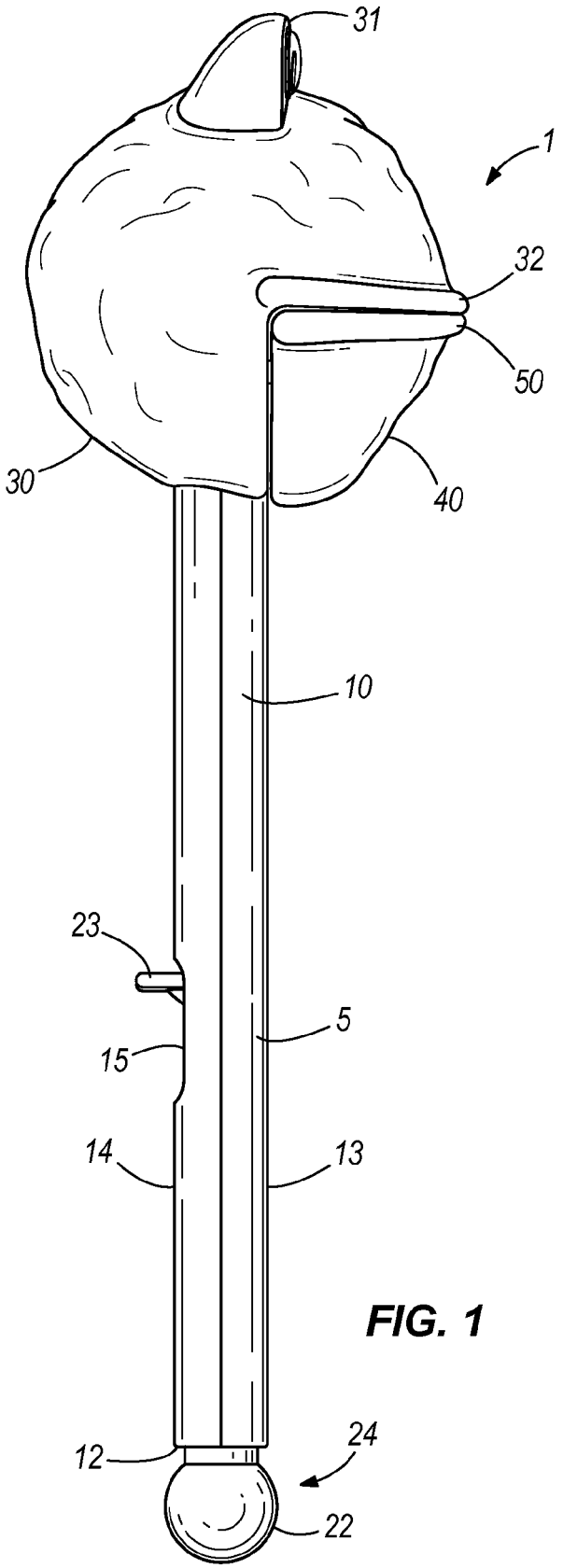
FIG. 1 is a left side elevational view of the puppet according to an embodiment of the invention in a first position.

Before any embodiments of the invention are explained in detail, it is to be understood that the invention is not limited in its application to the details of construction and the arrangement of components set forth in the following description or illustrated in the above-described drawings. The invention is capable of other embodiments and of being practiced or of being carried out in various ways.

As shown in FIGS. 1-6, the puppet 1 has a generally tube-shaped body 5 with a head 30 attached to the top of the body 5. The tube-shaped body 5 includes a hollow outer shaft 10 and an inner shaft 20 disposed substantially within the outer shaft 10. The outer 10 and inner 20 shafts may be formed of a variety of materials, such as wood, metal, plastic or composite material, such as PVC.

The outer shaft 10 includes a top end 11 connected to the head 30 and a bottom end 12 from which the inner shaft 20 protrudes. The outer shaft 10 may be formed of a semi-cylindrical front plate 13 joined to a semi-cylindrical rear plate 14. The outer shaft 10 includes a longitudinally oriented first slot 15 on the rear plate 14 between the top 11 and bottom 12 ends. The first slot 15 receives a lever 23 (to be described below). The outer shaft 10 further includes a second slot 16 (shown in FIG. 5) on the front plate 13 near the top end 11.

The inner shaft 20 is disposed substantially within the outer shaft 10 and is slidable telescopically in a longitudinal direction relative to the outer shaft 20. As best viewed in FIGS. 4 and 6, the inner shaft 20 includes a top end 21 disposed near the top end 11 of the outer shaft 10 and a bottom end 22 that protrudes from the bottom end 12 of the outer shaft 10. The inner shaft 20 has a generally cylindrical shape near the ends 21, 22 and a generally semi-cylindrical shape in its middle. Near the upper end 21 is a connector receiving section 25 which receives a connector (not shown) to couple the jaw 40 to the inner shaft 20. A lever 23 is connected to the inner shaft 20 and extends outward therefrom through the first slot 15 formed in the outer shaft 10.

The bottom end 22 of the inner shaft 20 is preferably shaped so as to not be insertable into the outer shaft 10. For example, as shown in FIGS. 1-4, an end member 24 may optionally be connected to or formed on or near the bottom end 22 of the inner shaft 20. As shown in FIGS. 1-4, the end member 24 may have a rounded, spherical shape. However, the end member 24 can have any suitable shape. The end member 24 is also shaped so as to not be insertable into the outer shaft 10. This may be achieved by forming end member 24 with a dimension that is larger than a dimension of the bottom end 12 of the outer shaft 10.

A first puppet piece 30 (a head in FIGS. 1-3) is disposed around the top end 11 of the outer shaft 10. The puppet head 30 shown in FIGS. 1-3 includes a pair of eyes 31 and a lip 32 that generally face in the same direction as the front plate 13. The head 30 can be made of a softer material compared to the outer shaft 10, such as rubberized plastic. The head 30 is attached to the outer shaft 10 by any means known in the art, for example, adhesive bonding, thermal bonding, or a snap fit.

Figure 2:
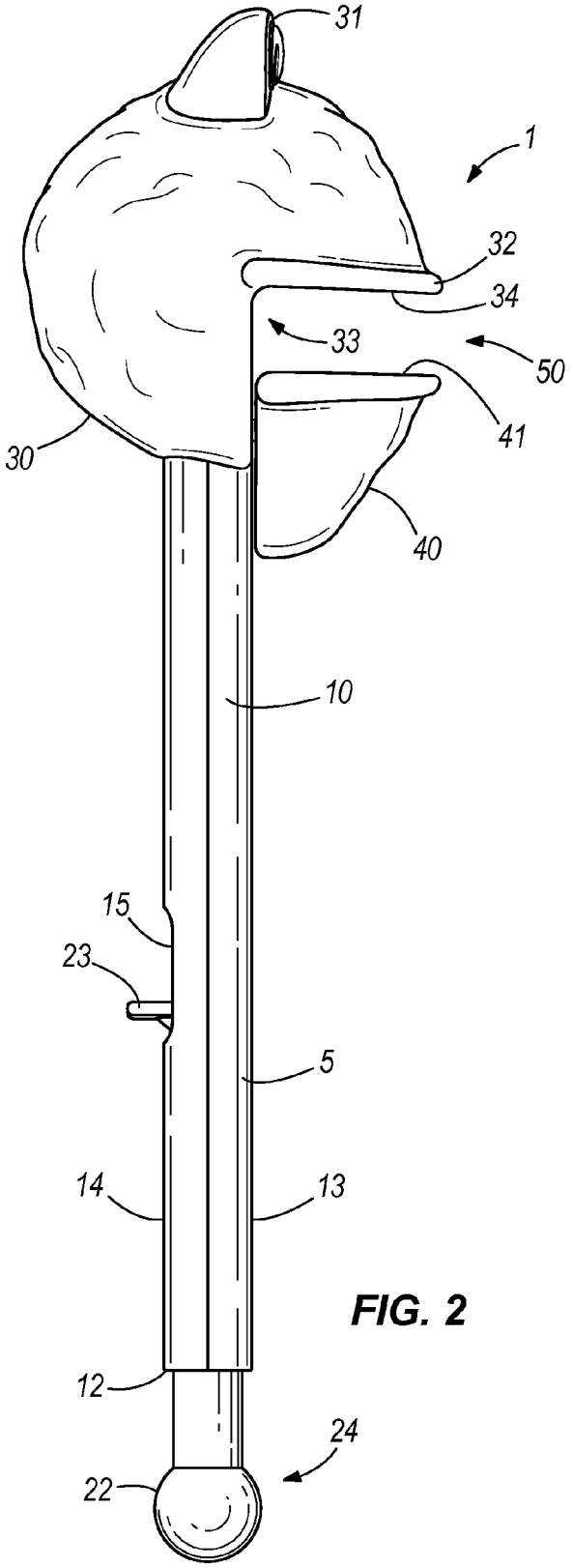
FIG. 2 is a left side elevational view of the puppet of FIG. 1 in a second position.
Figure 3:
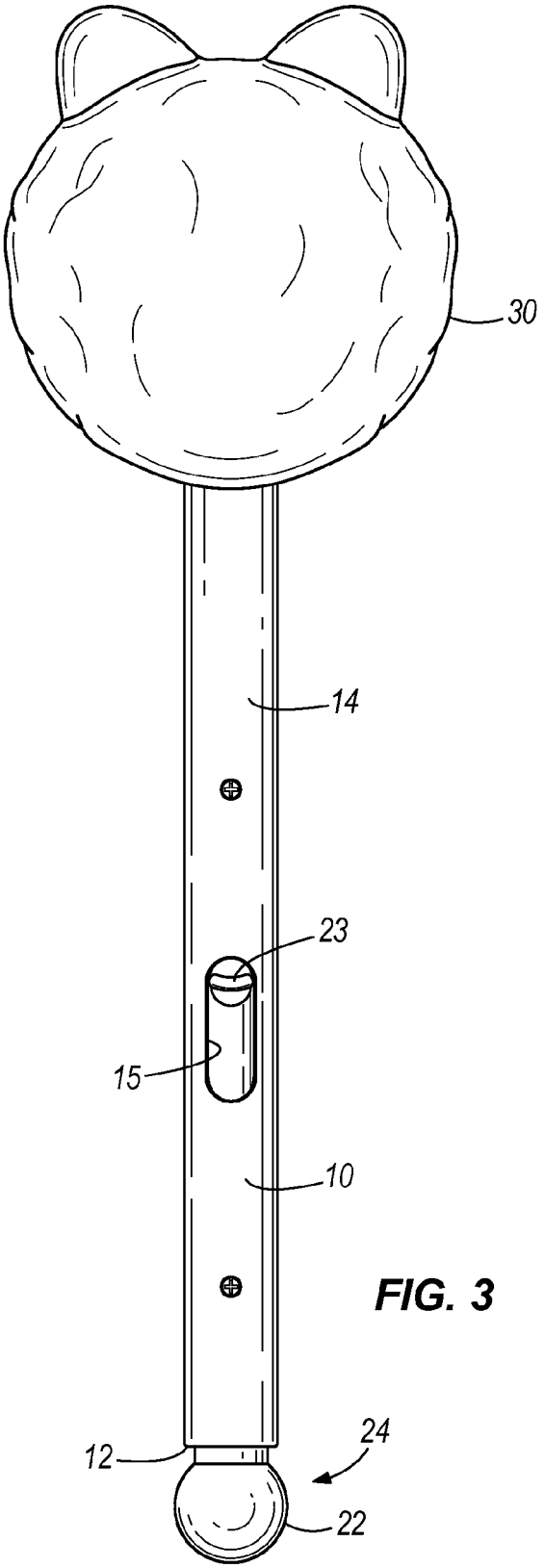
FIG. 3 is a rear elevational view of the puppet of FIG. 1.

Referring to FIG. 2, the head 30 has a concave portion 33 underneath the lip 32 to receive a second puppet piece 40 (a jaw in FIG. 2, to be described below). The concave portion 33 is partially defined by a mating surface 34, which mates or aligns with a mating surface 41 of the jaw 40. The concave portion 33 also includes an opening (not shown) which substantially overlaps the second slot 16 of the outer shaft 10 in order for the jaw 40 to connect to the inner shaft 20. The opening may have a size and shape substantially similar to the second slot 16.

With continued reference to FIGS. 1-4, the jaw 40 connects to the inner shaft 20 near the top end 21 thereof. The jaw 40 may be integral with the inner shaft 20 or may connect to the inner shaft 20 via the connector that connects to the connector receiving section 25 of the inner shaft 20. The connector extends laterally from the jaw 40 through the second slot 16 of the outer shaft 10 into the connector receiving section 25 to thereby couple the inner shaft 20 to the jaw 40. The upper mating surface 41 of the jaw 40 may align or mate with the mating surface 34 of the head 30 to define a mouth 50 of the puppet 1 therebetween. The mouth 50 may be substantially closed in an at-rest or default position of the puppet 1, or may be fully or partially open in the at-rest position. Alternatively, the opening formed between the first 30 and second 40 puppet pieces may be something other than a mouth.

In the at-rest, default position of the puppet shown in FIG. 1, the mating surface 41 of the jaw 40 is substantially flush with or adjacent to the mating surface 34 of the head 30 such that the mouth 50 of the puppet 1 is substantially closed and the bottom end 22 of the inner shaft 20 is substantially adjacent to the bottom end 11 of the outer shaft 10. Further, the lever 23 is substantially at the top of the first slot 15.

Figure 4:
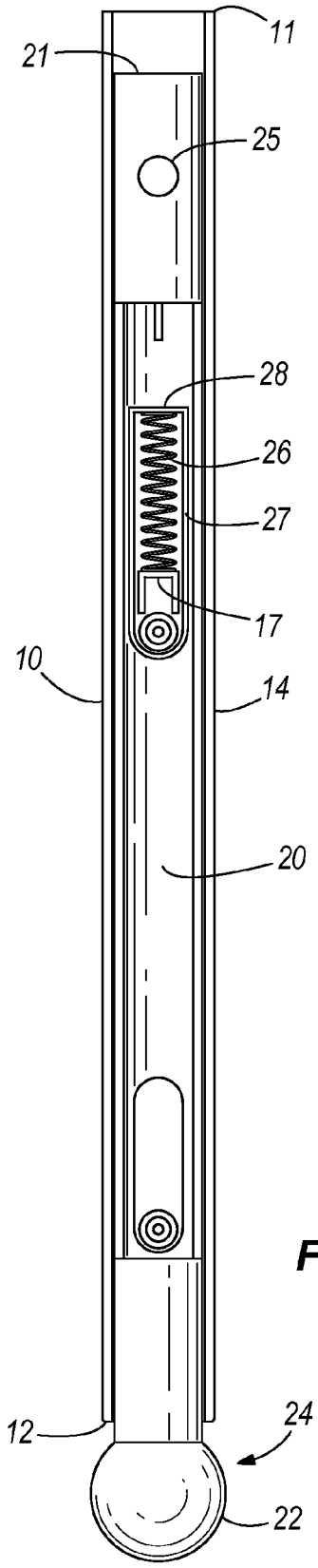
FIG. 4 is a rear elevational view of the puppet of FIG. 1 with the puppet head and front plate removed.
Figure 5:
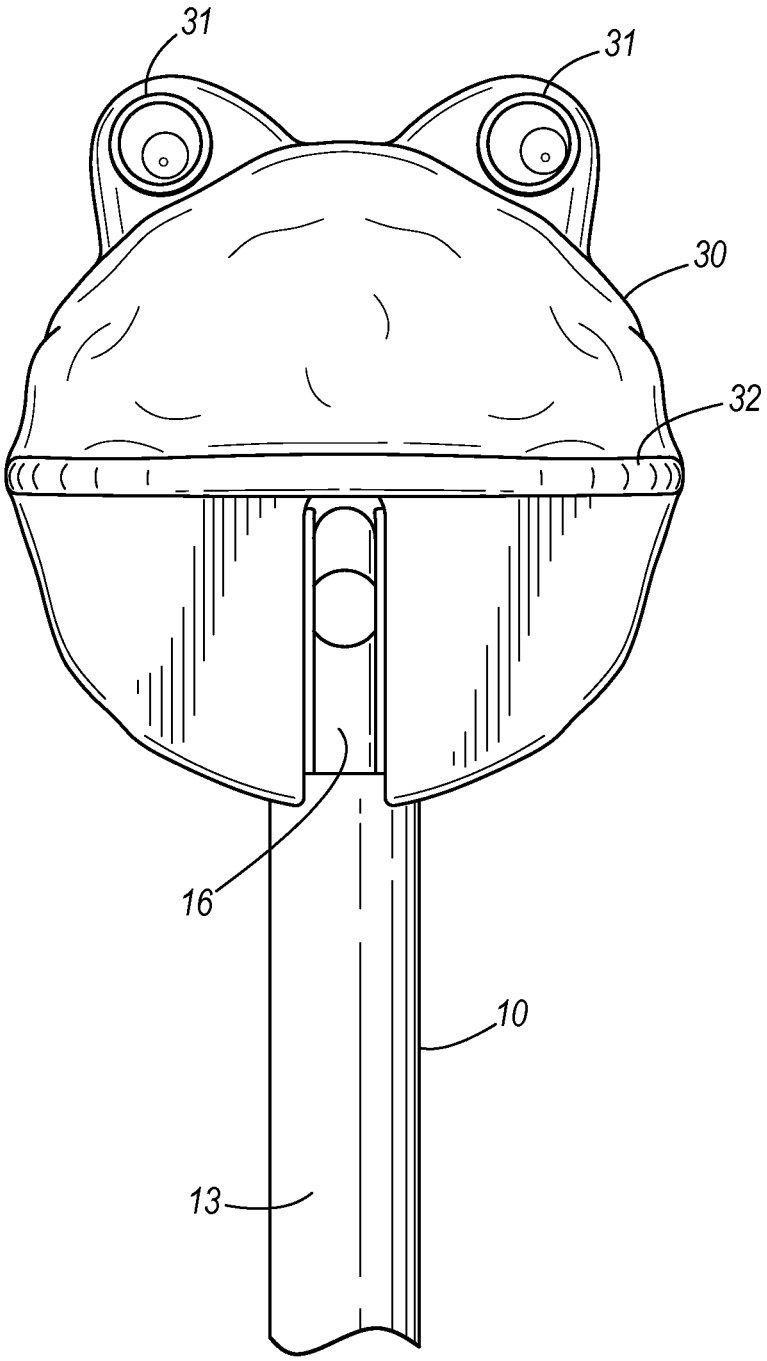
FIG. 5 is a front elevational view of the upper portion of the puppet of FIG. 1 with the puppet jaw removed.
Figure 6:
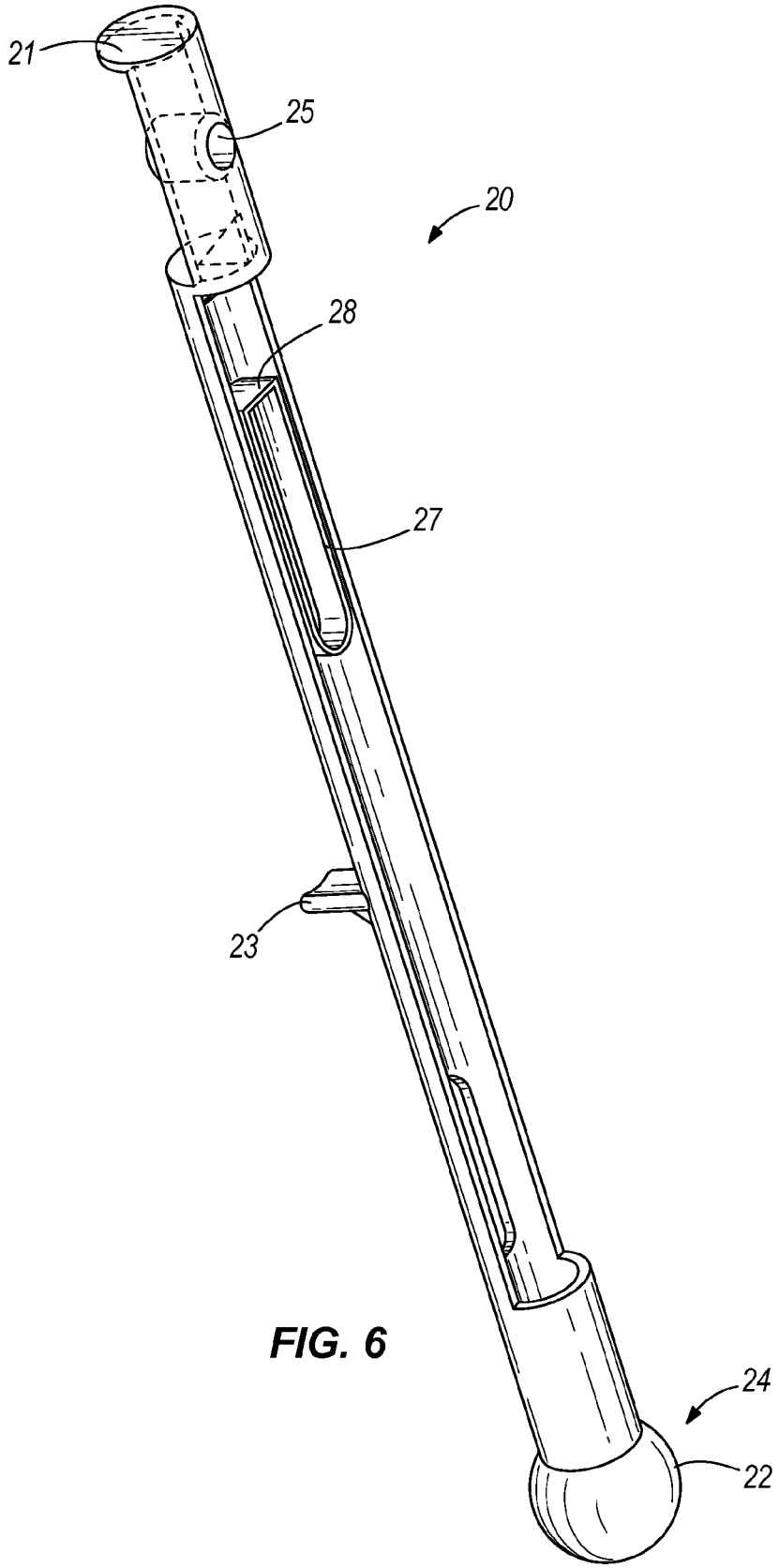
FIG. 6 is a perspective view of the inner shaft of the puppet of FIG. 1.

A biasing member (e.g. a spring or rubber band) 26 shown in FIG. 4 is longitudinally disposed within the outer shaft 10 and the inner shaft 20. More particularly, the biasing member 26 rests in a retaining section 27 formed in the inner shaft 20. A lower end of the biasing member 26 rests on a ledge 17 extending from the inner surface of the outer shaft 10, transversely to the longitudinal direction of the outer shaft 10, and through the inner shaft 20 into the retaining section 27. The biasing member 26 is bound at its upper end by the upper surface of the retaining section 27, which forms second ledge 28. The biasing member 26 is held in place on its sides by the inner shaft 20 and by a portion of the front plate 13 of the outer shaft 10. Thus, the biasing member 26 is coupled to both the outer 10 and inner 20 shafts.

The puppet 1 may then be actuated by sliding the lever 23 downwards relative to the outer shaft 10 or by pulling the bottom end 22 or the end member 24 of the inner shaft 20 downwards to slide the inner shaft 20 away from the outer shaft 10. In the resulting active position of the puppet 1, shown in FIG. 2 for example, the mating surface 41 of the jaw 40 is spaced from the mating surface 34 of the head 30 such that the mouth 50 is open and the bottom end 22 of the inner shaft 20 is spaced from the bottom end 12 of the outer shaft 10. To return to the at-rest position of FIG. 1, the user may simply release the lever 23 or the bottom end 22 of the inner shaft 20 and the biasing member 26 returns the puppet 1 to the at-rest position. This process may be repeated several times to simulate a speaking or other action of the puppet 1.

In the at-rest position of the puppet 1 in FIG. 1, the biasing member 26 is also in an at-rest position. Movement of the puppet 1 from the at-rest to the active position (FIG. 2) compresses the biasing member 26 such that releasing the lever 23 or the bottom end 22 of the inner shaft 22 urges the jaw 40 back into the at-rest position.

Alternatively, the mating surfaces 34, 41 could be spaced apart in the at-rest position and a movement of the lever 23 or the bottom end 22 of the inner shaft 20 from the at-rest position could bring the mating surfaces 34 and 41 closer together or even further apart. These variations share a common trait in that actuation of the puppet 1 results in changing the distance between the mating surfaces 34, 41.

Movement of the jaw 40 in the longitudinal direction towards the top end 11 of the outer shaft 10 is constrained by either or both of the top of the upper slot 16 or the top of the lower slot 15 formed in the outer shaft 10. Movement of the jaw 40 in a downward direction is constrained by either or both of the bottom of the upper slot 16 or the bottom of the lower slot 15.

The puppet 1 allows the user to hold and actuate the puppet 1 in a single hand, particularly by actuating lever 23. Alternatively, if actuation with more than one hand is desired, the user may hold the outer shaft 10 of the puppet 1 in one hand, while pulling the bottom end 22 of the inner shaft 20 downwards with the other hand.

Figure 7:
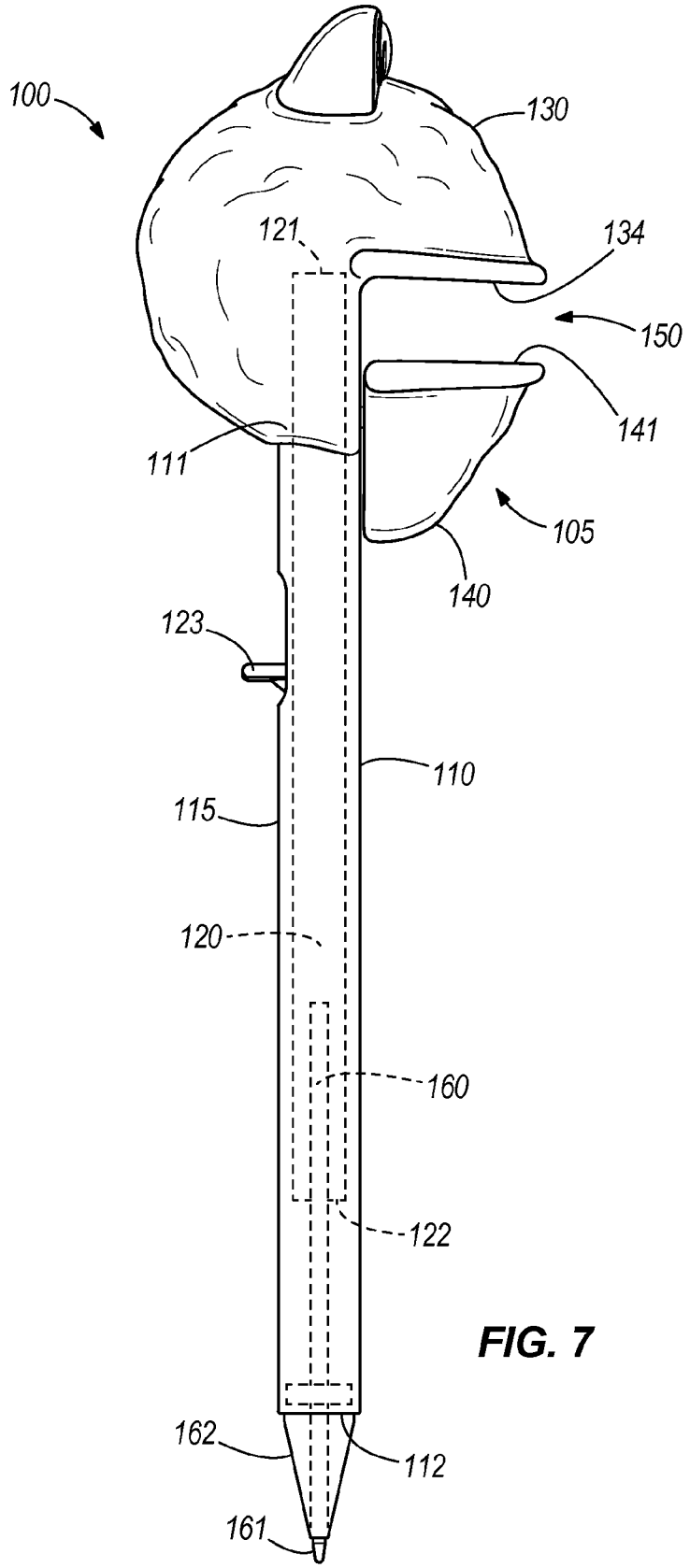
FIG. 7 is a left side plan view of an alternative embodiment of the invention.

An alternative embodiment of the invention can be seen in FIG. 7, which shows a combination puppet and writing utensil 100. Similar to the puppet 1, the combination 100 includes an outer shaft 110, an inner shaft 120, a head 130, a jaw 140, and a mouth 150 defined between the head 130 and jaw 140. The first puppet piece 130, second puppet piece 140, and the various sub-components thereof are structured and operate substantially similarly to corresponding parts of the puppet 1 described with reference to FIGS. 1-6. However, the combination 100 includes a writing utensil 160 (to be described below). Additionally, the puppet portion 105 of the combination 100 may only be actuated by movement of the lever 123 with the slot 115.

The outer shaft 110 includes a top end 111 connected to the head 130 and a bottom end 112 from which the writing utensil 160 protrudes. The outer shaft 110 may be formed of one piece or may include two semi-cylindrical plates joined together. The outer shaft 110 includes a longitudinally oriented first slot 115 between the top 111 and bottom 112 ends. The first slot 115 receives a lever 123 (to be described below). The outer shaft 110 further includes a second slot (not shown) near the top end 111, similar in placement to the second slot 16 of the puppet 1. An inner portion of the outer shaft 110 near the bottom end 112 may be threaded to receive a tip cone 162 (to be described below).

The inner shaft 120 is disposed substantially within the outer shaft 110 and is slidable telescopically in a longitudinal direction relative to the outer shaft 120. The inner shaft 120 includes a top end 121 disposed near the top end 111 of the outer shaft 110 and a bottom end 122 disposed near, but not protruding from, the bottom end 112 of the outer shaft 110. Whereas the bottom end 22 of the inner shaft 20 is shaped so as to not be insertable into the outer shaft 10, the bottom end 122 of the inner shaft 120 shown in FIG. 7 has an outer diameter less than the inner diameter of the outer shaft 110, and the bottom end 122 remains within the outer shaft 110 during actuation of the combination 100. In the at-rest, default position of the puppet 105, the bottom end 122 is spaced from the bottom end 112 of the outer shaft 110 to ensure that the bottom end 122 of the inner shaft 120 remains within the outer shaft 110 when the puppet 105 is fully actuated so that the bottom end 122 does not protrude into the tip cone 162 during actuation. The lever 123 to actuate the puppet 105 is connected to the inner shaft 120 and extends outward therefrom through the first slot 115 formed in the outer shaft 110.

The writing utensil 160 may include any conventional ball point pen (as in FIG. 7). The writing utensil 160 may include ink of any color, and may be non-retractable or retractable within the outer shaft 110. The writing utensil 160 is inserted into the outer shaft 110 so that a tip 161 of the writing utensil protrudes from the outer shaft 110. The tip cone 162 is then fitted to the bottom end 112 of the outer shaft 110 over the tip 161, thereby securely coupling the writing utensil 160 to the outer shaft 110. The tip cone 162 may be screwed into the threaded portion of the bottom end 112 or attached by any other means known in the art. The writing utensil 160 is removable from the outer shaft 110 so that it may be replenished or replaced with a writing utensil of a different type or color.

Similar to the puppet 1, the writing utensil 160 includes a biasing member (e.g. a spring or rubber band, not shown) longitudinally disposed within the outer shaft 110 and the inner shaft 120. The biasing member 160 biases the lever 123 into its at-rest or default position.

The puppet and writing utensil combination 100 may be actuated by sliding the lever 123 downwards relative to the outer shaft 110. In the resulting active position of the puppet 105, the mating surface 141 of the jaw 140 is spaced from the mating surface 134 of the head 130 such that the mouth 150 is open. To return to the at-rest position of FIG. 7, the user may simply release the lever 123 and the biasing member returns the jaw 140 and head 130 of the puppet 105 to the at-rest position. This process may be repeated several times to simulate a speaking or other action of the puppet 105.

Although embodiments of the invention have been shown and described, it is to be understood that various modifications, substitutions, and rearrangements of parts and components, as well as other uses, shapes and sizes of the wrist saver blocks, can be made by those skilled in the art without departing from the scope and spirit of one or more independent aspects of the invention as described.

The invention claimed is:

1. A puppet, comprising:

a hollow outer shaft having a first end and a second end;

an inner shaft disposed substantially within the outer shaft and slidable in a longitudinal direction relative to the outer shaft, the inner shaft having a first end and an opposing second end, the second end of the inner shaft extending outside of the outer shaft;

a first puppet piece attached to the outer shaft near the first end thereof;

a second puppet piece attached to the inner shaft near the first end thereof; and a lever connected to the inner shaft and extending outward therefrom through a first slot formed in the outer shaft, wherein one of the first and second puppet pieces is movable relative to the other by moving the lever relative to the outer shaft or by moving the second end of the inner shaft relative to the outer shaft, and movement of the second puppet piece in the longitudinal direction towards the second end of the outer shaft is constrained by a second slot 16 formed in the outer shaft.

2. The puppet according to claim 1, wherein in a first, default position of the puppet, the second puppet piece is substantially flush with the first puppet piece such that the second end of the inner shaft is substantially adjacent to the second end of the outer shaft.

3. The puppet according to claim 2, wherein in a second position of the puppet, the second puppet piece is spaced from the first puppet piece such that the second end of the inner shaft is spaced from the second end of the outer shaft.

4. The puppet according to claim 1, wherein the second end of the inner shaft protrudes laterally beyond edges of the outer shaft.

5. The puppet according to claim 4, wherein the second end of the inner shaft is shaped so as to not be insertable into the outer shaft.

6. The puppet according to claim 1, further comprising an end member connected to the second end of the inner shaft, wherein the end member is shaped so as to not be insertable into the outer shaft.

7. The puppet according to claim 2, further comprising a biasing member that urges the puppet into the first position.

8. A puppet, comprising:

a hollow outer shaft having a first end and a second end;

an inner shaft disposed substantially within the outer shaft and slidable in a longitudinal direction relative to the outer shaft, the inner shaft having a first end and an opposing second end, the second end of the inner shaft extending outside of the outer shaft;

a first puppet piece attached to the outer shaft near the first end thereof;

a second puppet piece attached to the inner shaft near the first end thereof;

a lever connected to the inner shaft and extending outward therefrom through a first slot formed in the outer shaft, wherein one of the first and second puppet pieces is movable relative to the other by moving the lever relative to the outer shaft or by moving the second end of the inner shaft relative to the outer shaft;

a biasing member that urges the puppet into a first default position of the puppet, wherein in the first default position of the puppet, the second puppet piece is substantially flush with the first puppet piece such that the second end of the inner shaft is substantially adjacent to the second end of the outer shaft, and wherein one end of the biasing member is bound by one of the inner shaft and outer shaft and the other end of the biasing member is bound by the other of the inner shaft and the outer shaft.

9. The puppet according to claim 1, wherein a movement of the second puppet piece towards the first end of the outer shaft is constrained by the first slot.

10. The puppet according to claim 1, wherein the first and second puppet pieces combine to form a head of the puppet.

11. The puppet according to claim 1, wherein the first and second puppet pieces form between them a mouth of the puppet.

12. A puppet, comprising:

a hollow outer shaft;

an inner shaft disposed substantially within the outer shaft and slidable in a longitudinal direction relative to the outer shaft;

a first puppet piece attached to the outer shaft;

a second puppet piece attached to the inner shaft;

a writing utensil coupled to the outer shaft;

a biasing member coupled to the inner shaft and the outer shaft; and a lever connected to the inner shaft and extending outward therefrom through a first slot formed in the outer shaft, wherein the biasing member holds the first and second puppet pieces in either a first position relative to each other or a second position relative to each other, the second position different from the first position, and the puppet is movable between the first and second positions by sliding the lever relative to the outer shaft or by sliding the inner shaft relative to the outer shaft.

13. The puppet according to claim 12, wherein the first position is a default position where the first and second puppet pieces are substantially adjacent, and the second position is an active position where the first and second puppet pieces are spaced from each other.

14. A puppet, comprising:

a hollow outer shaft having an upper end and a lower end;

an inner shaft disposed substantially within the outer shaft and slidable in a longitudinal direction relative to the outer shaft, the inner shaft having an upper end and a lower end;

a first puppet piece attached to the outer shaft near the upper end thereof;

a second puppet piece attached to the inner shaft near the upper end thereof, the second puppet piece having a mating surface that faces a mating surface of the first puppet piece;

a writing utensil coupled to the lower end of the outer shaft;

a biasing member coupled to the inner shaft and the outer shaft; and a lever connected to the inner shaft and extending outward therefrom through a first slot formed in the outer shaft, wherein the biasing member biases the puppet in a default position in which the mating surfaces of the first and second puppet pieces are at a first puppet piece distance from each other and the lower end of the inner shaft is at a first shaft distance from the lower end of the outer shaft, and wherein the puppet is movable from the default position to the active position by sliding the lever relative to the outer shaft or by sliding the lower end of the inner shaft relative to the outer shaft whereby the biasing member compresses into an active position in which the mating surfaces of the first and second puppet pieces are at a second puppet piece distance from each other different from the first puppet piece distance, and the lower end of the inner shaft is at a second shaft distance from the lower end of the outer shaft different from the first shaft distance.

15. The puppet according to claim 14, wherein each of the second distances is greater than the first distances.

16. The puppet according to claim 14, wherein each of the second distances is less than the first distances.

17. The puppet according to claim 14, wherein in the default position, the mating surfaces of the first and second puppet pieces are substantially adjacent.

* * * * *

UNITED STATES PATENT AND TRADEMARK OFFICE

CERTIFICATE OF CORRECTION

PATENT NO. : 8,795,026 B2
APPLICATION NO. : 13/483993
DATED : August 5, 2014
INVENTOR(S) : Brent Alan Geppert It is certified that error appears in the above-identified patent and that said Letters Patent is hereby corrected as shown below:

In the Claims,

Column 5, Claim 1, line 32, delete "16" after "second slot".

Signed and Sealed this
Seventeenth Day of March, 2015

Michelle K. Lee

Michelle K. Lee
*Director of the United States Patent and Trademark Office*